US012565752B2

(12) United States Patent
Luo et al.

(10) Patent No.: US 12,565,752 B2
(45) Date of Patent: Mar. 3, 2026

(54) DRAINAGE PRESSURE RELIEF ANTI-FLOATING SYSTEM SUITABLE FOR WEAKLY PERMEABLE SOFT STRATUM

(71) Applicant: SOUTH CHINA UNIVERSITY OF TECHNOLOGY, Guangzhou (CN)

(72) Inventors: Guanyong Luo, Guangzhou (CN); Fei Yang, Guangzhou (CN); Hong Pang, Guangzhou (CN); Hong Cao, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 225 days.

(21) Appl. No.: 18/557,059

(22) PCT Filed: Oct. 31, 2022

(86) PCT No.: PCT/CN2022/128823
§ 371 (c)(1),
(2) Date: Oct. 25, 2023

(87) PCT Pub. No.: WO2023/103651
PCT Pub. Date: Jun. 15, 2023

(65) Prior Publication Data

US 2024/0229410 A1 Jul. 11, 2024

(30) Foreign Application Priority Data

Dec. 8, 2021 (CN) ..... 202123085751.2

(51) Int. Cl.
*E02D 31/12* (2006.01)

(52) U.S. Cl.
CPC ..... *E02D 31/12* (2013.01)

(58) Field of Classification Search
CPC ..... E02D 31/12
See application file for complete search history.

(56) References Cited

FOREIGN PATENT DOCUMENTS

CN 105569095 5/2016
CN 112144584 A * 12/2020 ..... E02D 31/12
(Continued)

OTHER PUBLICATIONS

Jun Huang et al., "Application of Basement Drainage Decompression and Anti-floating Construction Technology in Hengqin Port and Comprehensive Transportation Hub Development Project", Building Construction, Foundation Bed & Foundation, Sep. 25, 2020, with English abstract, pp. 1630-1632, vol. 42, No. 9.
(Continued)

*Primary Examiner* — Joshua K Ihezie
(74) *Attorney, Agent, or Firm* — JCIPRNET

(57) ABSTRACT

Disclosed in the present invention is a drainage pressure relief anti-floating system suitable for a weakly permeable soft stratum. The drainage pressure relief anti-floating system comprises a pressure relief well body and an artificial hydrophobic layer, wherein longitudinal bars are arranged in stand columns of a sand-free concrete well wall, and are anchored into concealed beams. The pressure relief well body is located in the artificial hydrophobic layer, a construction surface of the artificial hydrophobic layer is located on the weakly permeable soft stratum, a wicker fence layer is laid on the weakly permeable soft stratum, a biaxially stretched plastic geogrid is laid on the wicker fence layer, a medium coarse sand layer is laid on the biaxially stretched plastic geogrid, and a crushed stone layer is laid on the medium coarse sand layer.

14 Claims, 2 Drawing Sheets

(56) References Cited

FOREIGN PATENT DOCUMENTS

| | | | |
|---|---|---|---|
| CN | 212477844 | | 2/2021 |
| CN | 212477844 U | * | 2/2021 |
| CN | 216640547 | | 5/2022 |
| JP | H11209998 | | 8/1999 |
| KR | 100753556 | | 8/2007 |
| KR | 20130062566 | | 6/2013 |

OTHER PUBLICATIONS

"International Search Report (Form PCT/ISA/210) of PCT/CN2022/128823", mailed on Jan. 4, 2023, with English translation thereof, pp. 1-5.

* cited by examiner

DRAINAGE PRESSURE RELIEF ANTI-FLOATING SYSTEM SUITABLE FOR WEAKLY PERMEABLE SOFT STRATUM

CROSS-REFERENCE TO RELATED APPLICATION

This application is a 371 of international application of PCT application serial no. PCT/CN2022/128823, filed on Oct. 31, 2022, which claims the priority benefit of China application no. 202123085751.2, filed on Dec. 8, 2021. The entirety of each of the above mentioned patent applications is hereby incorporated by reference herein and made a part of this specification.

TECHNICAL FIELD

The present invention belongs to the technical field of drainage pressure relief anti-floating of underground construction, and in particular to a drainage pressure relief anti-floating system suitable for a weakly permeable soft stratum.

RELATED ART

At present, the development of urban underground space is in full swing, and anti-floating measures should be taken for underground structures with high groundwater level and unsatisfactory anti-floating safety factor. Drainage through pressure relief wells is economical and effective, and bottom portions of traditional anti-floating pressure relief wells are typically arranged in a hard earth layer or a rock layer. However, in some coastal cities, the underground weakly permeable soft stratum is usually deep. When pressure relief wells are arranged in such stratum, the hydrophobic layer necessary for the traditional drainage pressure relief system is missing and blocking is easy to occur; precipitation funnel is too small; and carrying out construction in a soft earth layer is difficult, particularly construction during the rainy season. Moreover, with the increase of use time, the pressure relief wells may settle due to their own weight, which may lead to failure of the drainage pressure relief system.

Cao Hong et al. have disclosed a drainage interception pressure relief anti-floating system in the Chinese granted patent "Drainage Interception Pressure Relief Anti-floating System", including a waterproof curtain arranged around an underground structure; several sumps arranged under a floor of the underground structure; a submersible pump and a water level sensing switch arranged in the sump; a well hole arranged at a bottom portion of the sump; a pressure relief well pipe arranged in the well hole; and an anti-filter layer arranged around the pressure relief well pipe. The top portion of the pressure relief well pipe is higher than the well hole and the anti-filter layer and is located in the sump. The pressure relief well pipe is mainly formed by stacking several sand-free concrete well rings coaxially up and down, the sand-free concrete well ring including an annular upper ring beam and a lower ring beam, a stand column, and a sand-free concrete wedge-shaped block. However, if this prior art is used for a weakly permeable soft stratum, it would have the following defects:

1. A weakly permeable stratum, in which water is difficult to flow, will lead to small precipitation funnel, poor precipitation effect, and even impossible to achieve precipitation. Moreover, it is very difficult to use the prior art to work on a soft stratum such as silt formation, and the problem of falling into the silt may occur;

2. In the prior art, the bottom portion of the pressure relief well should be arranged in a relatively weakly permeable stratum (i.e., a hard earth layer or a rock layer), otherwise the well settling may occur, and if the soft earth layer is deep, the well needs to be drilled deep to reach the hard earth layer or the rock layer, and the cost may be greatly increased.

SUMMARY OF INVENTION

Technical Problem

Solution to the Problem

Technical Solution

An object of the present invention is to provide a drainage pressure relief anti-floating system suitable for a weakly permeable soft stratum in view of the limitations of the traditional drainage pressure relief anti-floating system in the embedded stratum environment at the present stage.

In order to achieve the above-mentioned object, the present invention provides a drainage pressure relief anti-floating system suitable for a weakly permeable soft stratum, including an artificial hydrophobic layer, a structural floor, several pressure relief well bodies arranged under the structural floor and a self-contained sump of a construction, the pressure relief well bodies and the sump being in communication via a pipeline;

the artificial hydrophobic layer being arranged on an outer side of a periphery of the pressure relief well bodies and being located in a weakly permeable soft stratum, and the artificial hydrophobic layer including a wicker fence layer, a biaxially stretched plastic geogrid, a medium coarse sand layer and a crushed stone layer arranged in sequence from bottom to top.

The present invention provides a drainage pressure relief anti-floating system suitable for a weakly permeable soft stratum. By laying a wicker fence layer, a construction surface is provided on which the light-weight construction machinery may be operated, and the difficulties in carrying out construction in a weakly permeable soft stratum are solved. By laying an artificial hydrophobic layer, the permeability coefficient of a weakly permeable soft stratum is increased, the range of precipitation is enlarged, and the problem of a small precipitation funnel when a pressure relief well drains water in a weakly permeable stratum is solved.

Further, the pressure relief well bodies and the sump are in communication via a steel-plastic composite pipe. When the water level in the pressure relief well body rises to a certain position, the water may flow into the sump through the steel-plastic composite pipe.

Further, the steel-plastic composite pipe is embedded in or under the structural floor, and a clear distance when embedded is greater than a pipe diameter. The clear distance refers to the remaining pure distance, i.e., the closest distance from surface to surface of two steel-plastic composite pipes.

Further, spiral stirrups are provided outside a pipe wall of the steel-plastic composite pipe.

By providing the spiral stirrups, it is possible to prevent corrosion caused by direct contact of the concrete with the steel-plastic composite pipe and the problem that the steel-plastic composite pipe would be blocked if infiltrated by the concrete.

Further, the biaxially stretched plastic geogrid has an open porosity of not less than 60%.

Further, the medium coarse sand layer has a thickness of at least 200 mm, and a sediment percentage of not more than 0.5%.

Further, the crushed stone layer has a thickness of at least 300 mm, a particle size of 5-20 mm and a sediment percentage of not more than 0.5%.

Further, a geotextile layer, a plain concrete cushion layer and a waterproof layer are laid in sequence on the crushed stone layer.

A geotextile layer is laid on the upper surface of the hydrophobic layer to avoid the blocking caused by cement slurry leaking into the hydrophobic layer during the process of pouring the plain concrete cushion layer on the floor, thus affecting the drainage pressure relief effect.

Further, the crushed stone layer is covered with a waterproof color strip cloth layer when the plain concrete cushion layer is not cast and is subject to rainfall.

Further, well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

By anchoring the longitudinal bars arranged in the stand columns into the concealed beams to form hoisting, it is possible to solve the problem that the pressure relief wells may settle due to their own weight.

Advantageous Effects of the Invention

Advantageous Effects

Compared with the prior art, the present invention can achieve at least the following advantageous effects:

1. The pressure relief well and the artificial hydrophobic layer in the drainage pressure relief anti-floating system provided by the present invention are simple in construction and low in cost, such that the problems of a small precipitation funnel when a pressure relief well drains water in a weakly permeable soft stratum, well settling, difficulties in carrying out construction in a weakly permeable soft stratum, particularly construction during the rainy season, and soil conservation and silt prevention of a pressure relief well in a silt formation are solved.
2. The drainage pressure relief anti-floating system provided by the present invention reduces the buoyancy borne by a structural floor in the weakly permeable soft stratum, and greatly reduces the cost of arranging traditional anti-floating facilities in the weakly permeable soft stratum.
3. The drainage pressure relief anti-floating system provided by the present invention is particularly suitable for a weakly permeable soft stratum environment.
4. The drainage pressure relief anti-floating system provided by the present invention solves the problem that the pressure relief wells may settle due to their own weight by anchoring the longitudinal bars arranged in the stand columns into the concealed beams to form hoisting.

Effects of Invention

BRIEF DESCRIPTION OF DRAWINGS

FIG. 1A is a top view of a wellhead of a pressure relief well and in FIG. 1B is a schematic structural diagram of a drainage pressure relief anti-floating system suitable for a weakly permeable soft stratum provided by an embodiment of the present invention, wherein FIG. 1A is a top view of the wellhead of the pressure relief well in FIG. 1B and the vertical dash line in FIG. 1A is aligned with the vertical dash line in FIG. 1B.

Figure 1A:
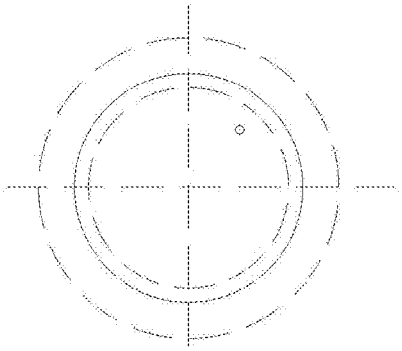

In the figures: 1. structural floor; 2. pressure relief well body; 3. steel-plastic composite pipe; 4. stand column; 5. longitudinal bar; 6. concealed beam; 7. wicker fence layer; 8. biaxially stretched plastic geogrid; 9. medium coarse sand layer; 10. crushed stone layer; 11. geotextile layer; 12. plain concrete cushion layer; 13. waterproof layer; 14. waterproof color strip cloth layer; 15. weakly permeable soft stratum.

DESCRIPTION OF EMBODIMENTS

In order to make the objects, technical solutions and advantages of the embodiments of the present invention more apparent, a clearer and more complete description of the embodiments of the present invention will be rendered by reference to the appended drawings. Obviously, the described embodiments are part of, but not all of, the present invention. Based on the embodiments of the present invention, all other embodiments obtained by a person of ordinary skill in the art without inventive effort are within the scope of the present invention.

In the description of the embodiments of the present invention, it is to be understood that the orientation or positional relationships indicated by directional terms such as "front, back, up, down, left, right", "transverse, vertical, perpendicular, horizontal", and "top, bottom", and the like, are generally based on the orientation or positional relationships illustrated in the drawings for ease of description and simplicity of the description and are not intended to indicate or imply that the devices or elements referred to must have a particular orientation or be constructed and operated in a particular orientation and, therefore, are not to be construed as limiting the scope of the present invention; and the directional terms "inner and outer" refer to inner and outer relative to the contour of each component itself.

Figure 1B:
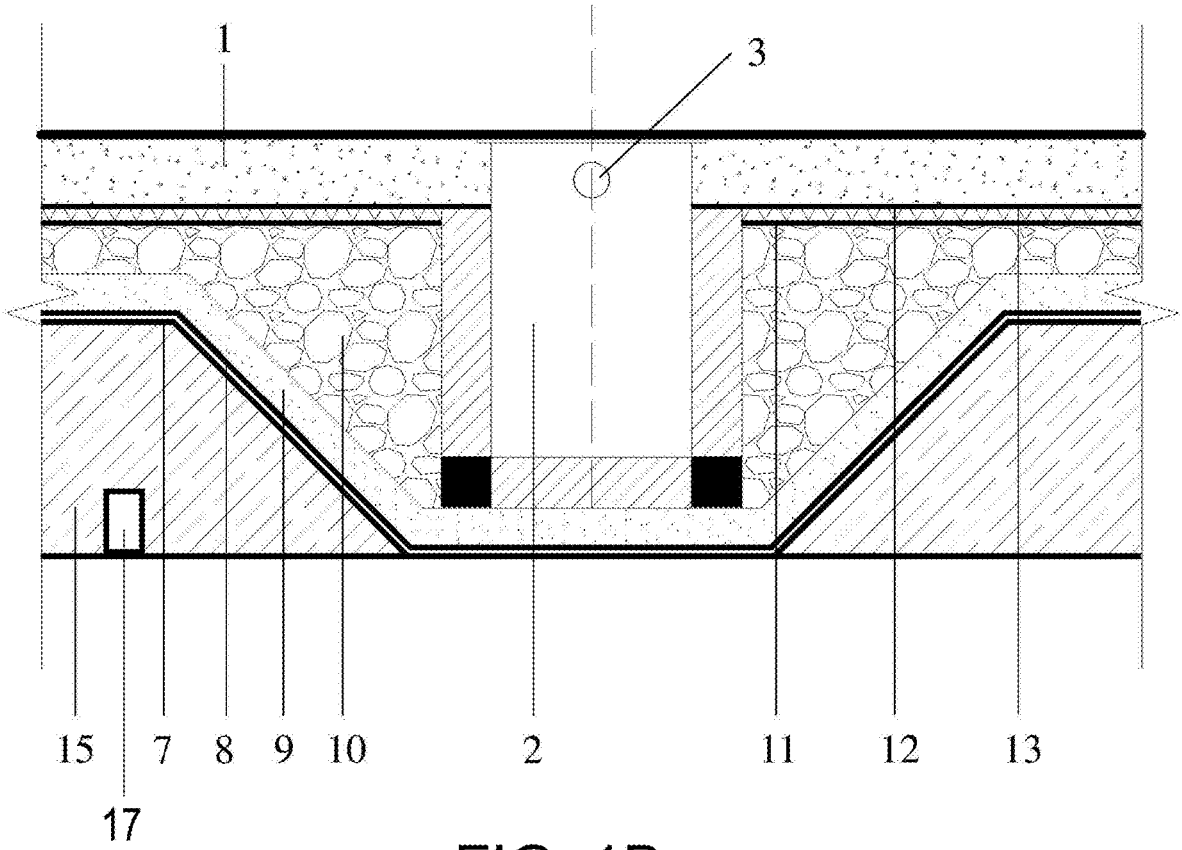
Figure 2:
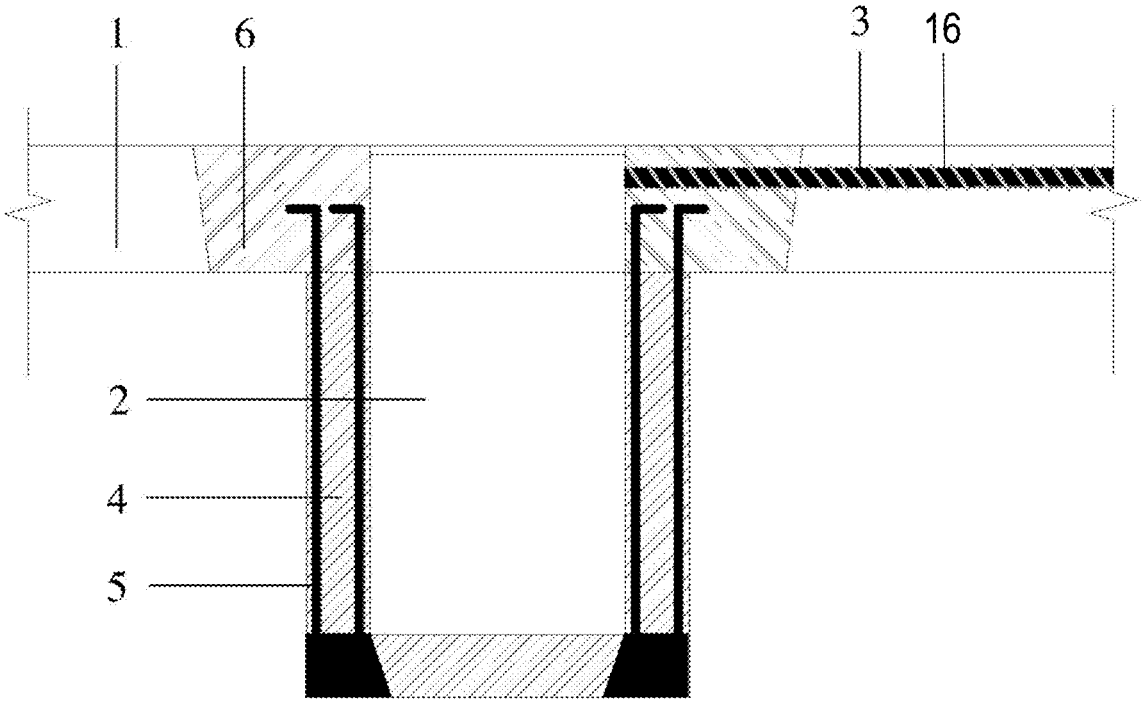
FIG. 2 is a schematic installation diagram of a pressure relief well according to an embodiment of the present invention.

With reference to FIGS. 1A, 1B and 2, the present invention provides a drainage pressure relief anti-floating system suitable for a weakly permeable soft stratum, including several pressure relief well bodies 2 arranged under the structural floor 1, the pressure relief well bodies 2 and the sump being in communication via a steel-plastic composite pipe 3.

In some of the embodiments of the present invention, the sump is a self-contained sump 17 of a construction, which is located under the structural floor 1, without the need for re-construction.

In some of the embodiments of the present invention, an artificial hydrophobic layer is arranged around the pressure relief well bodies 2, the artificial hydrophobic layer is located in a weakly permeable soft stratum 15, and the artificial hydrophobic layer includes a wicker fence layer 7, a biaxially stretched plastic geogrid 8, a medium coarse sand layer 9 and a crushed stone layer 10, and in particular, a construction surface is provided by laying the wicker fence layer 7 on the weakly permeable soft stratum 15, the biaxially stretched plastic geogrid 8 is laid on the wicker fence layer 7, the medium coarse sand layer 9 is laid on the biaxially stretched plastic geogrid 8, and the crushed stone layer 10 is laid on the medium coarse sand layer 9. For construction needs, a geotextile layer 11 is laid on the crushed stone layer 10, a plain concrete cushion layer 12 is laid on the geotextile layer 11, and a waterproof layer 13 is laid on the plain concrete cushion layer 12. A geotextile layer is laid on the upper surface of the hydrophobic layer to avoid the blocking caused by cement slurry leaking into the hydrophobic layer during the process of pouring the plain concrete cushion layer on the floor, thus affecting the drainage pressure relief effect.

Wherein it is difficult for personnel and light-weight construction machinery to work on the deep soft stratum, and a construction surface is formed by using wicker fence layer 7 and biaxially stretched plastic geogrid 8, to solve the difficulties in carrying out construction on deep soft stratum. By laying medium coarse sand layer 9 and crushed stone layer 10 with the requirements of particle size and sediment percentage, the problem of poor permeability of the weakly permeable soft stratum is solved, the precipitation funnel is enlarged and the soil conservation and silt prevention are achieved. The crushed stone layer 10 has a strong permeability and a large accommodation space, through which the fine particles are easy to pass, and not easy to silt. Protected by the medium coarse sand layer under the crushed stone layer and the geogrid under the medium coarse sand layer, the fine particles are prevented from entering the crushed stone layer 10, while protecting the base soil.

In some of the embodiments of the present invention, the steel-plastic composite pipe 3 has a diameter of not less than 150 mm, and if the diameter is too small, the drainage effect may be affected.

In some of the embodiments of the present invention, spiral stirrups 16 having a diameter of not less than 3 mm and a spacing of not more than 90 mm are welded outside a pipe wall of the steel-plastic composite pipe 3. The concrete is poured after the installation is completed, and the bottom portion and side wall of the sump of the pressure relief well are integrally cast in situ with the main body structure. By providing the spiral stirrups 16, it is possible to prevent corrosion caused by direct contact of the concrete with the steel-plastic composite pipe 3 and the problem that the steel-plastic composite pipe 3 would be blocked if infiltrated by the concrete.

In some of the embodiments of the present invention, the nozzle of the steel-plastic composite pipe 3 is not less than 400 mm from the wellhead. The function of the steel-plastic composite pipe 3 is: when the water level in the pressure relief well rises to a certain position, the water may flow into the sump through the steel-plastic composite pipe 3. If the steel-plastic composite pipe 3 is very close to the wellhead, when the water level rises relatively fast, the drainage speed may be less than the water level rise speed, resulting in water overflow, and reserving a distance between the steel-plastic composite pipe and the wellhead is to prevent this problem from occurring.

In some of the embodiments of the present invention, the steel-plastic composite pipe is embedded in or under the structural floor, and a clear distance when embedded is greater than a pipe diameter. The clear distance refers to the remaining pure distance, i.e., the closest distance from surface to surface of two steel-plastic composite pipes.

In some of the embodiments of the present invention, the medium coarse sand layer 9 has a thickness of not less than 200 mm, and a sediment percentage of not more than 0.5%. In this embodiment, construction is carried out in the foundation pit. If the laying thickness is too large, the excavation depth of the foundation pit needs to be increased, which will greatly increase the cost; if the excavation depth is too small, the medium coarse sand layer 9 will sink, and the effect of the present invention cannot be achieved. Therefore, the thickness of not less than 200 mm is a more suitable setting.

In some of the embodiments of the present invention, the crushed stone layer 10 has a thickness of not less than 300 mm, a particle size of 5-20 mm, and a sediment percentage of not more than 0.5%. In this embodiment, construction is carried out in the foundation pit. If the laying thickness is too large, the excavation depth of the foundation pit needs to be increased, which will greatly increase the cost; if the excavation depth is too small, the crushed stone layer 10 will sink, and the effect of the present invention cannot be achieved. Therefore, the thickness of not less than 300 mm is a more suitable setting.

In some of the embodiments of the present invention, as shown in FIG. 2, the pressure relief well body 2 has an internal diameter of not less than 1200 mm, the well wall has a thickness of not less than 300 mm, and the pressure relief well has a depth of not less than 1500 mm.

In some of the embodiments of the present invention, with reference to FIG. 2, well walls of the pressure relief well bodies 2 are provided with stand columns 4, longitudinal bars 5 are arranged in stand columns 4 penetrating the whole stand columns 4, and top portions of the longitudinal bars 5 are anchored into concealed beams 6, the concealed beams 6 are arranged in a structural floor, and the longitudinal bars 5 in the structural floor 1 are cut off and then bent when meeting the concealed beams 6. The role of the stand columns is to provide a structure for the longitudinal bars 5 which cannot be placed directly in sand-free concrete. The longitudinal bars 5 are used for hoisting to ensure that the pressure relief wells do not settle.

Figure 3:
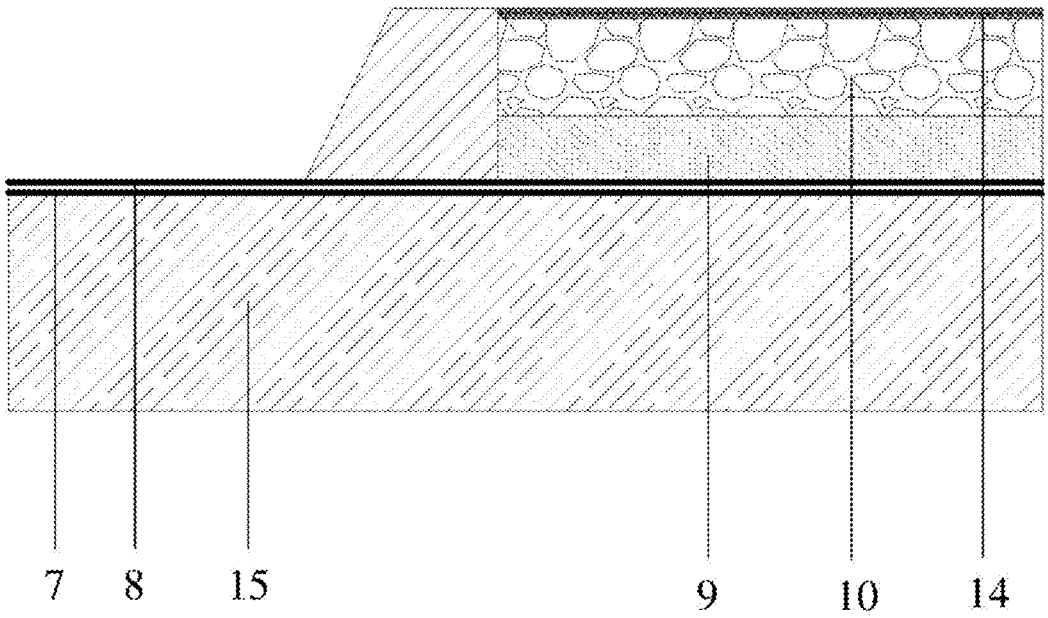
FIG. 3 is a schematic diagram of the protective measures against heavy rainfall during the laying of a hydrophobic layer according to an embodiment of the present invention.

As shown in FIG. 3, in the process of laying the artificial hydrophobic layer, in case of heavy rainfall, the bare soil slope in the pit should be well protected, so as to avoid the heavy rain scouring and carrying a large amount of sediment into the pit, thereby threatening the unfinished artificial hydrophobic layer. In case of heavy rainfall, sand-bag cofferdams should be added to the periphery where the artificial hydrophobic layer has been laid to prevent muddy water from flowing into the artificial hydrophobic layer from the side wall. When the plain concrete cushion layer 12 located above the artificial hydrophobic layer is not cast, the crushed stone layer 10 should also be covered with a waterproof color strip cloth 14 to prevent the intrusion of muddy water into the artificial hydrophobic layer from the top portion.

A total of 24 drainage pressure relief anti-floating systems suitable for weakly permeable soft stratums provided by the present invention were used in Serensia Woods of Hengqin, Zhuhai. The following is a comparison result of the drainage pressure relief effect between the drainage pressure relief anti-floating systems suitable for weakly permeable soft stratums of the present invention and the original sump. Under rainstorm conditions, the seepage analysis was carried out by arranging 24 drainage pressure relief anti-floating systems suitable for weakly permeable soft stratums, and it was found that the water head of basement floor decreased by about 6.0-9.0 m compared with the water head around the site, and the water head reduction value of about 90% area of basement floor was more than 7.0 m; and the maximum water pressure of local floor was 50 kPa. Therefore, the pressure relief effect is obvious. Under normal conditions, the water head of basement floor decreased by about 4.0-6.5 m compared with the water head around the site after adopting the scheme of 24 pressure relief wells, and the water head reduction value of about 90% area of basement floor was more than 5.0 m. The maximum water pressure near the outer wall of the basement was up to 20 kPa, and the water pressure at the floor of most areas was less than 10 kPa.

The actual application effect of the present invention shows that the drainage pressure relief anti-floating system suitable for a weakly permeable soft stratum greatly reduces the number of uplift piles and uplift anchors used for the anti-floating structure in the weakly permeable soft stratum without driving the bottom portion of the pressure relief well into the rock layer, reduces the depth of the pressure relief well, reduces the water pressure on the structural floor 1 in the weakly permeable soft stratum, greatly reduces the construction cost, saves the construction period, and the construction process is simple and easy to operate, and the operation status is good after completion in a plurality of construction cases; in particular, it has unparalleled applicability and reliability for coastal areas and areas with deep and weakly permeable soft stratums.

The present invention provides a drainage pressure relief anti-floating system suitable for a weakly permeable soft stratum. By laying an artificial hydrophobic layer, the permeability coefficient of a weakly permeable soft stratum is increased, the range of precipitation is enlarged, and the problem of a small precipitation funnel when a pressure relief well drains water in a weakly permeable stratum is solved. By anchoring the longitudinal bars arranged in the stand columns into the concealed beams to form hoisting, the problem that the pressure relief wells may settle due to their own weight is solved. In response to the problem that the light-weight construction machinery and the construction personnel are unable to work on the silt formation, the present invention provides a construction surface by laying a wicker fence layer on which the light-weight construction machinery may be operated, and the difficulties in carrying out construction in a weakly permeable soft stratum are solved. The present invention may achieve soil conservation and silt prevention by controlling the particle size and gradation relationship of medium coarse sand layer and crushed stone layer and the sediment percentage as well as using sand-free concrete on the well wall.

In the above description, numerous specific details are set forth in order to provide a thorough understanding of the present invention. However, the above description is only of a preferred embodiment of the present invention and the present invention can be practiced in many other ways than described herein. Therefore, it is intended that the present invention not be limited to the particular embodiments disclosed above. At the same time, any person skilled in the art can make many possible variations and modifications or equivalent embodiments of the present invention using the methods and techniques disclosed above without departing from the scope of the present invention. Any simple modification, equivalent variation and amendment to the above embodiments according to the technical spirit of the present invention without departing from the contents of the technical solution of the present invention all fall within the scope of protection of the technical solution of the present invention.

What is claimed is:

1. A drainage pressure relief anti-floating system suitable for a weakly permeable soft stratum, comprising an artificial hydrophobic layer, a structural floor, several pressure relief well bodies arranged under the structural floor and a self-contained sump of a construction, the pressure relief well bodies and the sump being in communication via a steel-plastic composite pipe;

the artificial hydrophobic layer being arranged on an outer side of a periphery of the pressure relief well bodies and being located in a weakly permeable soft stratum, and the artificial hydrophobic layer comprising a wicker fence layer, a biaxially stretched plastic geogrid, a medium coarse sand layer and a crushed stone layer arranged in sequence from bottom to top, wherein spiral stirrups are provided outside a pipe wall of the steel-plastic composite pipe.

2. The drainage pressure relief anti-floating system suitable for a weakly permeable soft stratum according to claim 1, wherein the steel-plastic composite pipe is embedded in or under the structural floor.

3. The drainage pressure relief anti-floating system suitable for a weakly permeable soft stratum according to claim 1, wherein the biaxially stretched plastic geogrid has an open porosity of not less than 60%.

4. The drainage pressure relief anti-floating system suitable for a weakly permeable soft stratum according to claim 1, wherein the medium coarse sand layer has a thickness of at least 200 mm, and a sediment percentage of not more than 0.5%.

5. The drainage pressure relief anti-floating system suitable for a weakly permeable soft stratum according to claim 1, wherein the crushed stone layer has a thickness of at least 300 mm, a particle size of 5-20 mm and a sediment percentage of not more than 0.5%.

6. The drainage pressure relief anti-floating system suitable for a weakly permeable soft stratum according to claim 1, wherein a geotextile layer, a plain concrete cushion layer and a waterproof layer are laid in sequence on the crushed stone layer.

7. The drainage pressure relief anti-floating system suitable for a weakly permeable soft stratum according to claim 6, wherein the crushed stone layer is covered with a waterproof color strip cloth layer when the plain concrete cushion layer is not cast and is subject to rainfall.

8. The drainage pressure relief anti-floating system suitable for a weakly permeable soft stratum according to claim 1, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

9. The drainage pressure relief anti-floating system suitable for a weakly permeable soft stratum according to claim 2, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

10. The drainage pressure relief anti-floating system suitable for a weakly permeable soft stratum according to claim 3, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

11. The drainage pressure relief anti-floating system suitable for a weakly permeable soft stratum according to claim 4, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

12. The drainage pressure relief anti-floating system suitable for a weakly permeable soft stratum according to claim 5, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

13. The drainage pressure relief anti-floating system suitable for a weakly permeable soft stratum according to claim 6, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

14. The drainage pressure relief anti-floating system suitable for a weakly permeable soft stratum according to claim 7, wherein well walls of the pressure relief well bodies are provided with stand columns, longitudinal bars are arranged in the stand columns, and top portions of the longitudinal bars are anchored into concealed beams, a section of the longitudinal bars anchored into the concealed beams is provided with a bending portion, and the concealed beams are arranged on the structural floor.

* * * * *